United States Patent [19]

Bolongeat-Mobleu et al.

[11] Patent Number: 4,910,485

[45] Date of Patent: Mar. 20, 1990

[54] MULTIPLE CIRCUIT BREAKER WITH DOUBLE BREAK ROTARY CONTACT

[75] Inventors: Roger Bolongeat-Mobleu, Echirolles; Jean-Pierre Nereau, La Tronche, both of France

[73] Assignee: Merlin Gerin, France

[21] Appl. No.: 258,705

[22] Filed: Oct. 17, 1988

[30] Foreign Application Priority Data

Oct. 26, 1987 [FR] France ..... 87 14964

[51] Int. Cl.[4] ..... H01H 3/00

[52] U.S. Cl. ..... 335/195; 200/244; 200/248; 200/287

[58] Field of Search ..... 200/144 R, 244, 248, 200/251, 287, 305; 335/185, 196, 195, 200, 201

[56] References Cited

U.S. PATENT DOCUMENTS 3,177,332 4/1965 Bethke ..... 200/251 X 4,649,247 3/1987 Preuss et al. ..... 200/248 X

FOREIGN PATENT DOCUMENTS 0174904 3/1986 European Pat. Off. .

2845950 4/1980 Fed. Rep. of Germany .

*Primary Examiner*—J. R. Scott

*Attorney, Agent, or Firm*—Arnold, White & Durkee

[57] ABSTRACT

A breaking device for a low voltage circuit breaker comprises in each pole a switching bar, a pair of stationary contacts connected to the connection terminals, a double-break rotary contact extending in a housing of the bar, and two arc chutes disposed on each side of the bar. Two contact pressure springs ensure elastic positioning of the rotary contact along the longitudinal direction of the pole. Pivoting of the rotary contact takes place around a fictitious axis mounted floating with respect to the fixed rotation axis of the bar.

5 Claims, 3 Drawing Sheets

Fig. 1
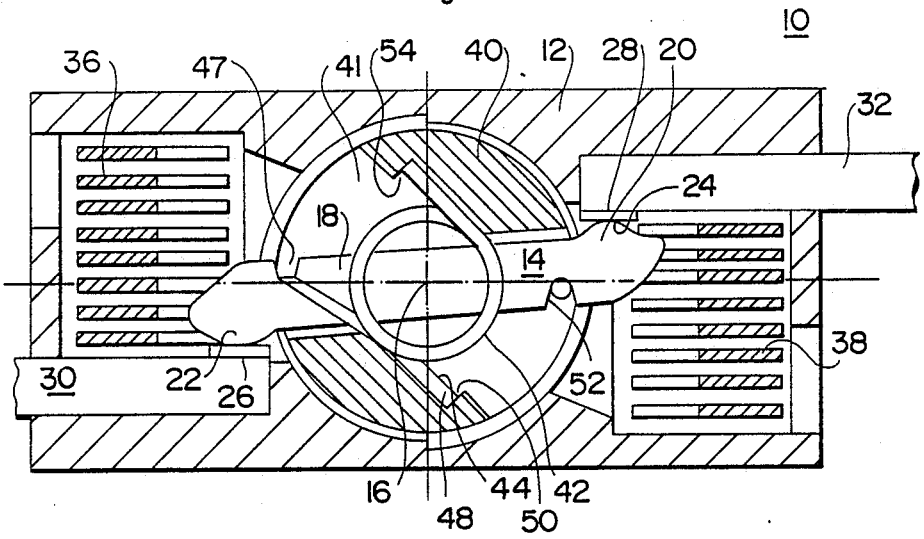
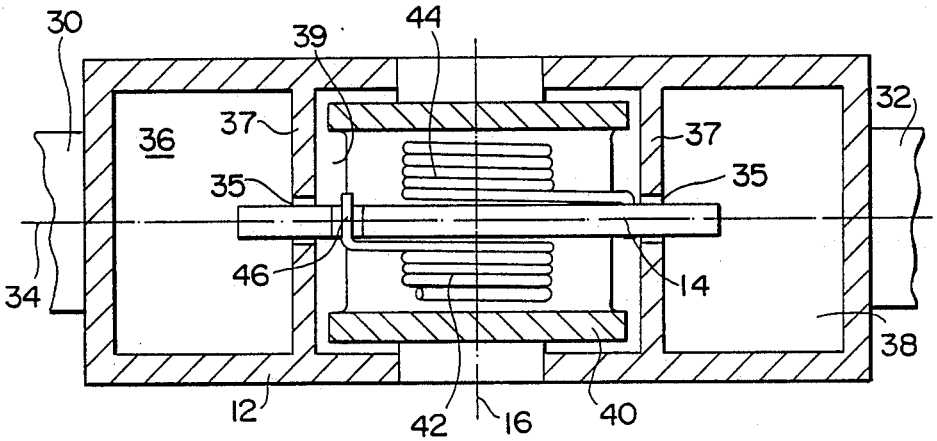
Fig. 2

Fig. 3
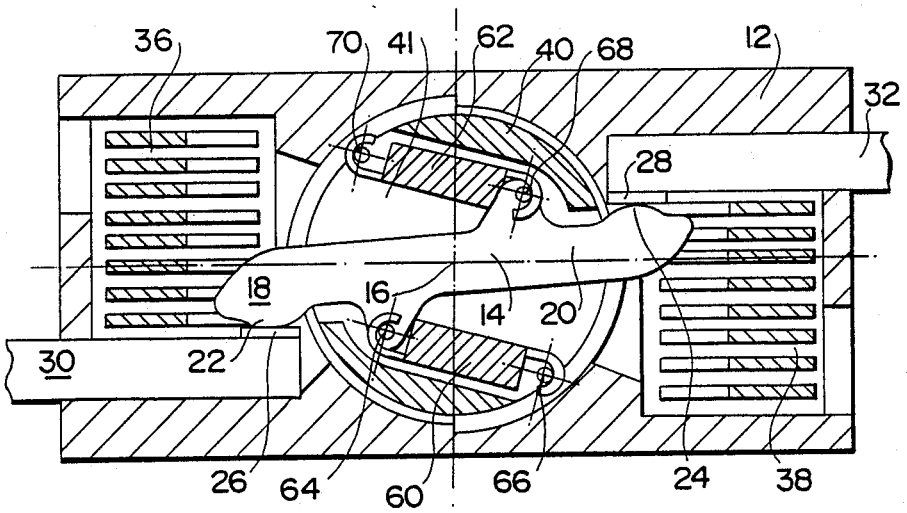
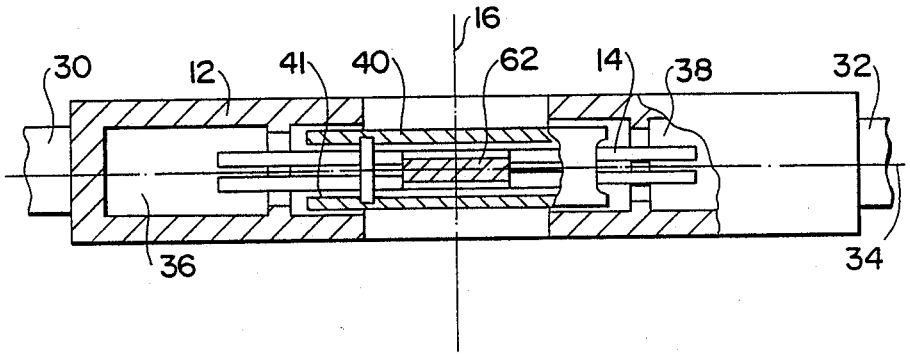
Fig. 4

MULTIPLE CIRCUIT BREAKER WITH DOUBLE BREAK ROTARY CONTACT

BACKGROUND OF THE INVENTION

The invention relates to a breaking device for a low voltage molded case multipole circuit breaker, comprising a rotary switching bar guided in rotation around a first transverse fixed axis by means of bearings arranged in the case, said first axis being perpendicular to the longitudinal direction of each pole, which comprises;

a pair of stationary contacts connected to the connection terminals;

a double-break rotary contact extending in a housing of the bar in the longitudinal direction of the pole, and having opposing contact parts cooperating with the stationary contacts in the closed position;

a pair of springs arranged inside the housing of the bar to cooperate with the rotary contact ensuring a predetermined contact pressure of the contact parts on the stationary contacts.

The use of a double-break rotary contact in a circuit breaker enables two arcs to be connected in series favoring a high breaking capacity. In a hyperstatic system with full rotation guiding of the movable contact, the problem of uniform distribution of the contact pressure on the two stationary contacts arises. A solution to this problem is proposed in the document U.S. Pat. No. 4,649,247, in which the centre part of the rotary contact comprises an oblong hole slotted onto a fixed support rod to form a guiding system having a degree of freedom in translation. The fixed support rod is cylindrical in shape and is mounted coaxially in the bar, so that the rotary contact can move slightly in the direction perpendicular to the longitudinal axis of the pole to ensure a balanced contact pressure at the level of the two breaking gaps. The diameter of the rod corresponds appreciably to the width of the oblong hole, and any movement of the rotary contact in the longitudinal direction is rendered impossible. The longitudinal positioning of the rotary contact is accurately determined by the support rod, which imposes stringent manufacturing tolerances.

In the double-break rotary switch according to the document DE-OS-2,845,950, the contact pressure springs do not ensure efficient self-centering of the movable contact in the longitudinal extension direction of the connection terminals. The positioning of the movable contact with respect to the stationary contacts is liable to be modified in the course of the life-time of the switch. This results in a longitudinal offset of the contacts detrimental to breaking of the arc.

The object of the invention consists in simplifying the assembly of a double-break rotary contact on the switching bar of a molded insulating case circuit breaker.

SUMMARY OF THE INVENTION

The breaking device according to the invention is characterized in that the rotary contact is elastically positioned by the springs along the longitudinal direction of the pole, and is capable of pivoting inside the housing around a second fictitious axis, mounted floating with respect to the first fixed axis of the bar, the rotary contact being maintained inside the bar housing with two degrees of freedom in translation, capable of simultaneously generating a uniform distribution of the contact pressure torque on the two pairs of contacts due to the first degree of freedom, and an equilibrium position of the rotary contact obtained by self-centering effect of the springs in the longitudinal direction due to the second degree of freedom.

Assembly of the rotary contact is simplified, and the presence of only the two springs ensures self-centering of the rotary contact on the second axis. The latter may be the same as the first transverse fixed axis of the bar, or on the other hand move in a plane perpendicular to the first axis.

The springs cooperating with the rotary contact may be torsion, tension or compression springs.

BRIEF DESCRIPTION OF THE DRAWINGS

Other advantages and features will become more clearly apparent from the following description of several illustrative embodiments of the invention, given as non-restrictive examples only and represented in the accompanying drawings, in which:

FIG. 1 is a schematic vertical sectional view of a breaking device according to the invention, the circuit breaker contacts being represented in the closed position;

FIG. 2 is a horizontal sectional view of FIG. 1;

FIGS. 3 and 4 show similar views to those of FIGS. 1 and 2, of an alternative embodiment;

DESCRIPTION OF THE PREFERRED EMBODIMENT

Figure 5:
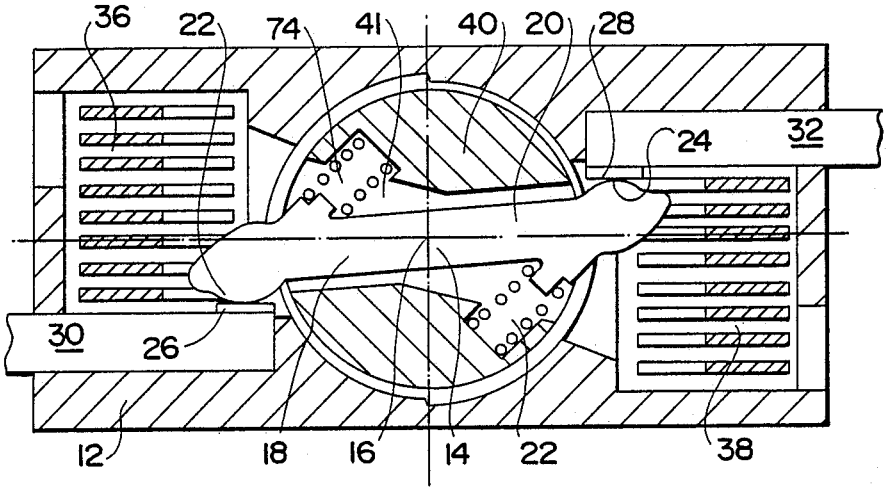
FIGS. 5 and 6 represent similar views to those of FIGS. 1 and 2, of another alternative embodiment.

Referring now to FIGS. 1 and 2, a breaking pole 10 of a low voltage circuit breaker is housed in a compartment of the case 12 made of molded insulating material. The pole 10 comprises a double-break rotary contact 14 capable of pivoting around a rotation axis 16 between a closed position (FIG. 1) and an open position (not shown). The rotation axis 16 is located in the centre zone of the pole 10, and the rotary contact 14 is formed by a pair of lever arms 18, 20 extending between the rotation axis 16 and two opposing contact parts 22, 24 cooperating respectively with stationary contacts 26, 28.

Electrical connection of the pole is acomplished by means of two connection terminals 30, 32 passing through two opposite faces of the case 12. The terminals 30, 32 are aligned in the longitudinal direction 34 of the pole, and their internal ends bear the stationary contacts 26, 28. An arc chute 36, 38 comprising a stack of metal plates is associated with each pair of contacts 26, 22; 28, 24 located on either side of the rotation axis 16.

In the closed position of the circuit breaker, the rated current flows through the main circuit of the pole being input via one of the terminals, for example 30, and then flowing through the stationary contact 26, the rotary contact 14, and the stationary contact 28, and being output from the pole via the other terminal 32. The clockwise rotation of the movable contact 14 causes simultaneous separation of the two pairs of contacts 26, 22; 28, 24 and formation of two arcs connected in series. The rotary contact 14 is driven in rotation by means of a switching bar 40 made of insulating material extending in the transverse direction of the rotation axis 16 of the contact 14. The bar 40 is guided in rotation around a fixed transverse axis by means of bearings arranged in the case 12.

The bar 40 occupies the central compartment 39 of the case 12, separated from the arc chutes 36, 38 by subdividing walls 37. Orifices 35 are arranged in the walls 37 for the movable contact 14 to pass through.

An operating mechanism (not shown) is mechanically coupled to the bar 40 to transmit the opening and closing movements to the various poles.

The rotary contact 14 of the pole 10 is positioned in a housing 41 of the bar 40 and extends perpendicularly to the transverse axis 16 and parallel to the longitudinal direction 34.

The functions of holding and guiding the rotary contact 14 inside the housing 41 are performed by a pair of torsion springs 42, 44 disposed coaxially along the rotation axis 16 on each side of the contact 14. The first torsion spring 42 comprises a curved end 46 hooked in a notch 47 of the lever arm 18, and the other end 48 is urged by the elasticity of the spring 42 up against an internal protrusion 50 of the bar 40. The hooking notch 47 of the spring 42 is located opposite the contact part 22.

The second spring 44 is similarly anchored in a notch 52 of the lever arm 20, and against an internal protrusion 54 of the bar 40. The two protrusions 50, 54 of the bar 40 are diametrically opposite with respect to the rotation axis 16.

The presence of the two torsion springs 42, 44 urges the rotary contact counterclockwise to ensure a uniform distribution of the contact pressure of the contact parts 22, 24 on the corresponding stationary contacts 26, 28, and at the same time allows the movable contact 14 to be elastically positioned along the longitudinal direction 34 of the pole. Inside the housing 41, the second fictitious rotation axis 16 of the movable contact 14 is mounted floating with respect to the first fixed axis of the bar 40. This results in the double-break movable contact 14 tending towards an equilibrium position in the longitudinal direction according to the manufacturing tolerances of the case 12 and of the bar 40.

According to the alternative embodiment in FIGS. 3 and 4, positioning of the rotary contact 14 in the housing 41 of the bar 40 is accomplished by means of two tension springs 60, 62 disposed in the mid-plane whose trace is the longitudinal direction 34 of the pole. The first tension spring 60 is inserted between a catch 64 fixed onto a boss of the lever arm 18, and an anchoring lug 66 securedly united to the bar 40. The second tension spring 62 is similarly mounted between a catch 68 of the lever arm 20 and a lug 70 of the bar 40. The two catches 64 and 68 of the double-break rotary contact 14 are diametrically opposite with respect to the rotation axis 16. The same is true for the two lugs 66 and 70 of the bar 40. The two tension springs 60, 62 extend parallel to one another in an oblique direction with respect to the horizontal direction 34 (FIG. 3). Arranging the springs 60, 62 in such a way enables both a contact pressure torque and an equilibrium position of the rotary contact 14 in the longitudinal direction 34 to be generated.

Figure 6:
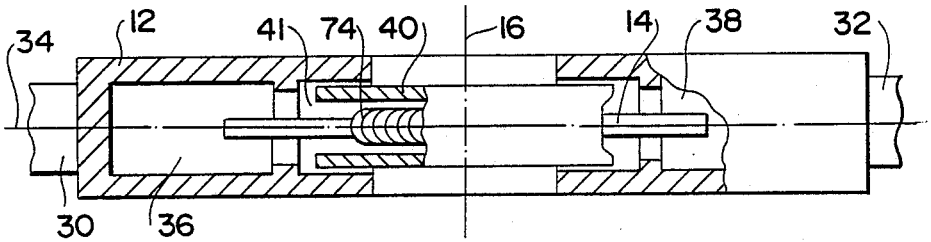

In FIGS. 5 and 6, the rotary contact 14 is associated with two compression springs 72, 74 enabling the contact pressure on the stationary contacts 26, 28 and the longitudinal equilibrium position to be achieved.

In the three alternative embodiments in FIGS. 1 to 6, it can be seen that the rotary contact 14 can be separated from the stationary contacts 26, 28 by electrodynamic repulsion effect, while the bar 40 remains immobile until tripping of the operating mechanism occurs.

We claim:

1. A breaking device for a low voltage molded case multipole circuit breaker, comprising a rotary switching cross bar guided in rotation around a first transverse fixed axis by means of bearings arranged in the case, said first axis being perpendicular to the longitudinal direction of each pole, which comprises:

a pair of stationary contacts connected to corresponding connection terminals;

a notch being arranged in the cross bar for supporting a double-break rotary contact comprising a two-arm contact lever extending along said longitudinal direction, said rotary contact having opposing contact pieces cooperating with the stationary contacts in the closed position; and a pair of springs located within said notch and anchored between the rotary contact and the cross-bar;

wherein the rotary contact is elastically positioned in the notch with a first degree of freedom in translation enabling the rotary contact to be moved in a vertical direction for generating a balanced contact pressure on the two corresponding stationary contacts, and with a second degree of freedom in translation along said longitudinal direction to provide an equilibrium longitudinal position of the rotary contact by a self-centering effect of said springs, said first and second degrees of freedom extending at right angles.

2. The breaking device according to claim 1, having two arc chutes disposed on either side of the cross bar along the longitudinal direction, with interposed subdividing walls having orifices through which the movable contact passes.

3. The breaking device according to claim 2, wherein said springs comprise torsion springs symmetrically disposed with respect to the longitudinal direction of the pole, one of the ends of each spring being hooked onto a corresponding lever arm of the rotary contact and the other end being elastically urged against a protrusion of the bar.

4. The breaking device according to claim 2, wherein said springs comprise tension or compression springs extending parallel to one another in an oblique direction to the longitudinal direction.

5. The breaking device according to claim 1, wherein the rotary contact is separated from the stationary contacts by an electrodynamic repulsion effect, while the switching bar remains immobile until tripping of the operating mechanism occurs.

* * * * *